US005252084A

United States Patent [19]

Wakata

[11] Patent Number: 5,252,084

[45] Date of Patent: Oct. 12, 1993

[54] LEVER TYPE CONNECTOR

[75] Inventor: Shigekazu Wakata, Yokkaichi, Japan

[73] Assignee: Sumitomo Wiring Systems, Ltd., Mie, Japan

[21] Appl. No.: 960,808

[22] Filed: Oct. 14, 1992

[30] Foreign Application Priority Data

Oct. 14, 1991 [JP] Japan ..... 3-083064[U]

[51] Int. Cl.[5] ..... H01R 13/00

[52] U.S. Cl. ..... 439/157

[58] Field of Search ..... 439/152-160

[56] References Cited

U.S. PATENT DOCUMENTS 3,059,206 10/1962 Williams ..... 439/157
3,534,320 10/1970 Rushing ..... 439/157
3,836,938 9/1974 Barrett et al. ..... 439/157

FOREIGN PATENT DOCUMENTS

0459448A2 4/1991 European Pat. Off. .
2179506A 3/1987 United Kingdom .

*Primary Examiner*—Joseph H. McGlynn
*Attorney, Agent, or Firm*—Sughrue, Mion, Zinn, Macpeak & Seas

[57] ABSTRACT

In a connector of male and female interlocking terminals, a lever is provided on a first connector in a freely pivoting manner. Guide pins provided on a second connector are inserted to guide groove holes and the lever is operated to pull together and connect the second and first connectors. The lever is made of two parts. The first part is provided on one side of the housing and has a first arm with a guide channel. The second part is provided on the other side of the housing and has a second arm shaped to enable insertion thereof into the guide channel of the arm in the first part. Thus, the second arm is inserted into the guide channel of first arm and fixed at the desirable position by the positioning claws provided in the guide channel and on the second arm.

4 Claims, 3 Drawing Sheets

LEVER TYPE CONNECTOR

BACKGROUND OF THE INVENTION

1. Field of the Invention

The present invention relates to a lever type connector used to reduce the force required for a male-female connection between mating connecters accommodating wire harnesses therein and, more particularly, to a lever type connector comprising a lever unit whose size is variable according to the size of the mating connector housings.

2. Description of the Prior Art

In a connector having mating plug and receptacle units, a lever is commonly used to reduce the connecting force required to fit the mating units together. One example of such a connector is shown in FIG. 6.

This connector includes a mating plug unit 200 for accommodating a plurality of first electrical wires with male terminals (not shown) therein and a receptacle unit 100 for accommodating a plurality of second electrical wires with female terminals (not shown) therein. The first and second electrical wires are electrically connected by engaging the male and female terminals of wires when the plug unit 200 is inserted into the receptacle unit 100.

The plug unit 200 has a plurality of first terminal chambers 203 extending between opposite sides of a generally rectangular shaped housing 201. Each of first wires is held in each of first terminal chambers 203, such that the female terminal locates on the one side. The plug unit 200 further has a pair of guide pins 204 separately formed on outer opposite side surfaces aligned in a line perpendicular to the longitudinal direction of first terminal chambers 203. A flange portion 205 is provided on the opposite side to the side on which the female terminal is held.

The receptacle unit 100 has a receptacle housing 101 for receiving the plug unit 200 and accommodating the second wires therein. The receptacle unit 100 further has a lever unit 104 for reducing the force to press the plug unit 200 into a receptacle opening 113 of the receptacle housing 101. The lever unit 104 is installed on the receptacle housing 101 by a fixture unit 105 such that pivot pins **104*a* on the lever unit 104 are captured by slots 105*a* of the fixture unit, as shown in FIG. 6. Thus, the lever unit 104 can pivot with respect to a line X. The housing 101 further has a plurality of second terminal chambers 115 extending therein, in a direction approximately parallel to the line X, and being opened to the opening 113. Each of second wires is held in each of second terminal chambers 115, such that the male terminal overhangs from the side facing the opening 113 by a predetermined length for the engagement with the female terminal. A pair of notches 117 are separately formed in the opening 113 side edges of the housing 101 for receiving the guide pins 204 of the plug unit 200**.

The lever unit 104 is formed in a generally U-shaped configuration. On outer surface of the opposite side members of the lever unit 104, the pair of pivot pins **104*a* are separately formed in a position in alignment with the axis X. In each inner surface of side portions of the lever unit 104, a pair of guide grooves 104*b* are separately engraved from the edge portion by a predetermined depth. A pair of elongated guide channels 104*c* are also formed integrally with the guide grooves 104*b* in a curved line shape. A locking tab 104*d* is provided at the middle of the lever unit 104**.

When the plug unit 200 is inserted into the opening 113, each of pivot pins 204 is guided into the notch 117 by the guide groove **104*b* and guide channels 104*c*. As the lever unit 104 rotates down in a direction of the arrow A from the position shown in FIG. 6, the guide pins 204 captured in the notches 117 are further pressed by the guide channels 104*c*. A further rotation of the lever unit 104 causes the guide pins 204 to travel along the slots 105*a* in the direction B. Thus, when the lever unit 104 is completely rotated, the female and male terminals of wires accommodated in the connector 100 and 200, respectively, are firmly engaged and an electrical connection is made therebetween. At the same time, the locking tab 104*d* and the flange portion 205 are also engaged to lock the lever unit 104** at the position to prevent the connected wires from accidentally disconnecting.

With this connector design, the required number of terminal chambers will vary according to the number of terminals to be connected in the connectors, and the width W of the receptacle housing 101 will vary accordingly. The width W of the housing 101 will also vary when the size of the terminals varies.

The lever unit 104 on the receptacle unit 100 must therefore be molded according to the width of the connector housing. This means a different lever unit must be manufactured when the housing width changes because of a difference in the number or size of terminals. Manufacturers have therefore produced a specific lever unit for each different width of connector housing, and this duplication of parts necessarily increases unit costs.

SUMMARY OF THE INVENTION

The object of the present invention is therefore to provide a lever type connector device which solves these problems.

The present invention has been developed with a view to substantially solving the above described disadvantages and has for its essential object to provide an improved connector.

In order to achieve the aforementioned objective, a lever type connector which is used to connect at least one pair of first and second terminals comprises a first connector member for accommodating the first terminal therein and provided with a first engaging means and a second engaging means; a second connector member for accommodating the second terminal therein and provided with a third engaging means engageable to the first engaging means; and a substantially U-shaped lever unit pivotally provided on the second connector member having a center portion and two side portions connected to the opposite ends of the center portion. The center portion is contractible, and the side portions are provided with a fourth engaging means engageable to the second engaging means. When the lever unit pivots, the second engaging means engages with the fourth engaging means to force the first and second connector members into a firmly engaged state.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

Figure 1:
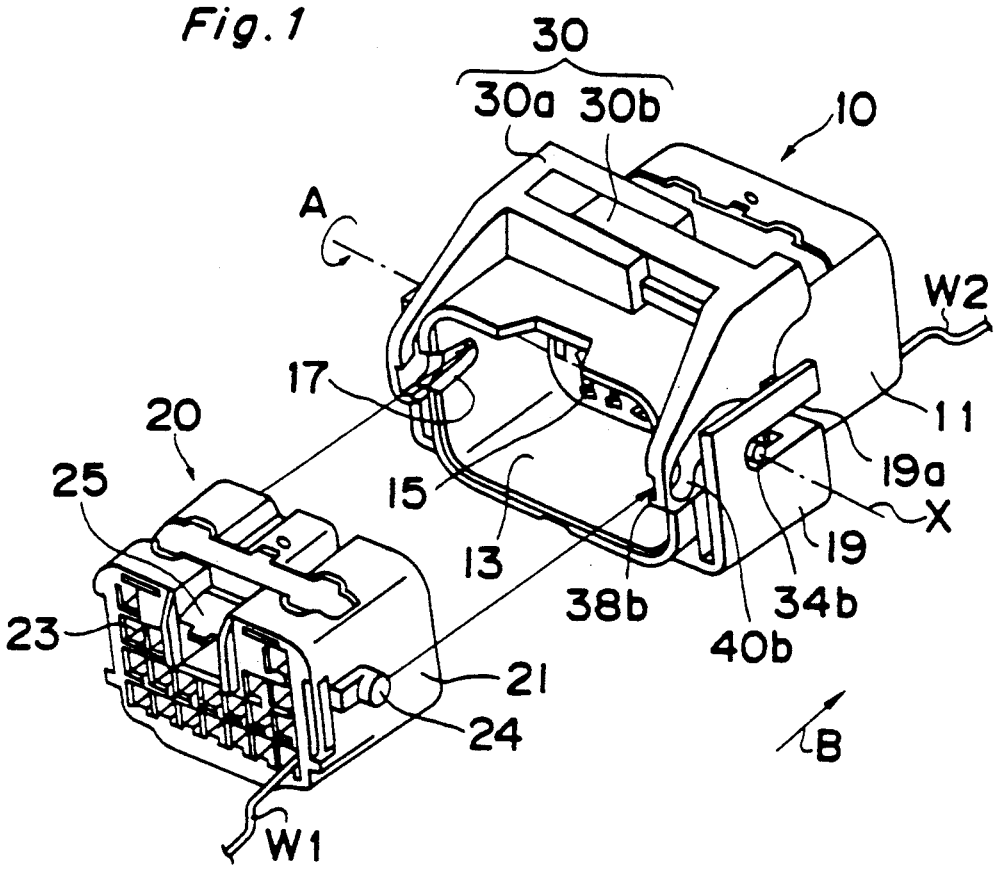
FIG. 1 is an exploded perspective view of a lever type connector according to a preferred embodiment of the present invention.

Referring to FIG. 1, a preferred embodiment of a lever type connector according to the present invention is shown.

The connector includes a mating plug unit 20 for accommodating a plurality of first electrical wires W1 with male terminals and a receptacle unit 10 and a plurality of second electrical wires W2 with female terminals. (only one pair of wires W1 and W2 is shown in FIG. 1 for the sake of brevity). When the plug unit 20 and receptacle unit 10 are engaged with each other, the first and second electrical wires W1 and W2 are electrically connected by mating the male and female terminals of wires W1 and W2 accommodated therein.

The plug unit 20 has a plug housing 21, configured in a generally cubic shape defined by first and second end faces and four side walls extending between the first and second sides end faces. The plug housing 21 is provided with a plurality of first terminal chambers 23 extending between the first and second end faces. The first wire W1 is accommodated inside each of first terminal chambers 23 such that the female terminal is located at the second end face. The plug unit 20 further has a pair of guide pins 24 which are formed on opposite side walls in alignment with a line perpendicular a direction in which the first terminal chambers 23 extend. A flange portion 25 is provided on the first end face of the plug unit 20.

The receptacle unit 10 has a receptacle housing 11 for accommodating the second wires W2, a lever unit 30, and a lever fixture unit 19 for installing the lever unit 30 on the housing 11 pivotally. The receptacle housing 11 is formed in a generally rectangular box-like configuration defined by four peripheral sides walls and a top side portion, opening at one side opposed to the top side. Since the top side portion has a predetermined thickness, the inside of the housing 11 is divided into two portions. One is the top side portion thick enough to accommodate an electric terminal therein. The other is a receptacle space 13, wide and deep enough to accommodate the plug unit 20 therein. The receptacle opening 13 is shown on the left side of the housing in FIG. 1. The housing 11 further has a plurality of second terminal chambers 15 extending inside the top side portion approximately parallel to the peripheral side walls. The second wire W2 is accommodated in each of second terminal chambers 15 such that the male terminal protruding from the chamber 15 toward the receptacle space 13 by a predetermined length for engagement with the female terminal of the first wire W1. A pair of slots 17 are formed in the open edges of opposite side walls of the housing 11 in a configuration to receive the guide pins 24 of the plug unit 20 therein.

Figure 2:
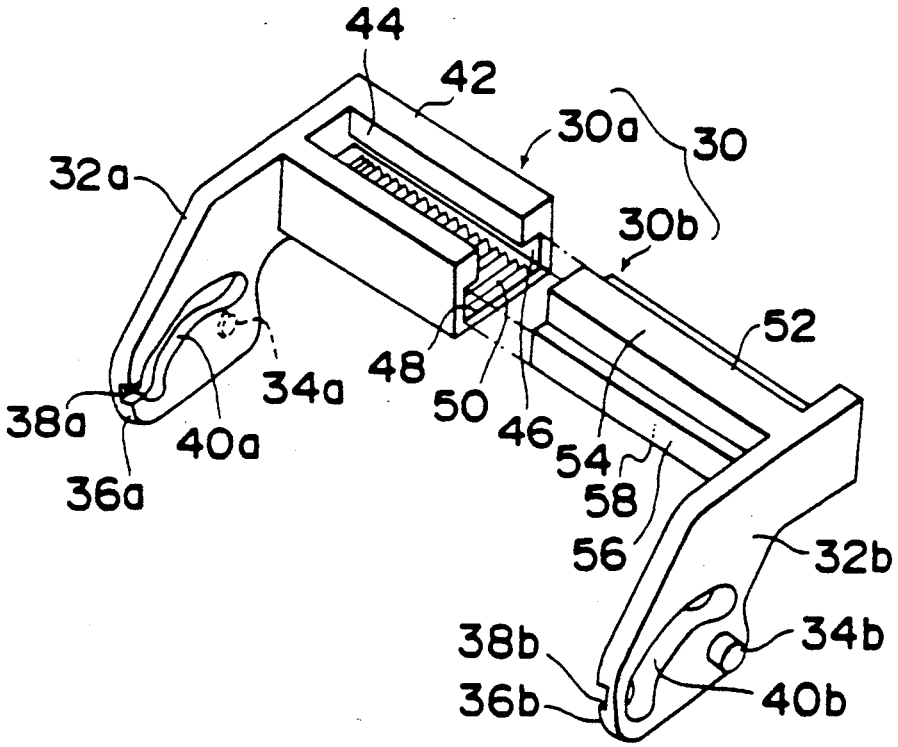
FIG. 2 is an exploded perspective view of a lever unit of the lever type connector set shown in FIG. 1.

Referring to FIG. 2, an enlarged view of the lever unit 30 is shown. The lever unit 30 comprises a receptacle member 30*a* and a plug member 30*b* both formed in generally L-shaped configurations. The receptacle and plug members 30*a* and 30*b* fit together, as shown in FIG. 1, and operate as the single lever 30 formed in a generally U-shaped configuration.

The receptacle member 30*a* has a left side portion 32*a* almost in a plate-like form having first and second surfaces. A first arm portion 42 is integrally provided on one of end portions of the first surface of left side portion 32*a*. The first arm portion 42 is an elongated rectangular shape extends therefrom in a direction perpendicular to the left side portion 32*a*. A guide channel 46 with a top opening 44, having an inverted T-shape in cross section, is formed in the first arm portion 42, extending in the longitudinal direction thereof. The guide channel 46 is closed at one side by the left side portion 32*a* and is open at the end remote from the left side portion 32*a*.

Figure 3:
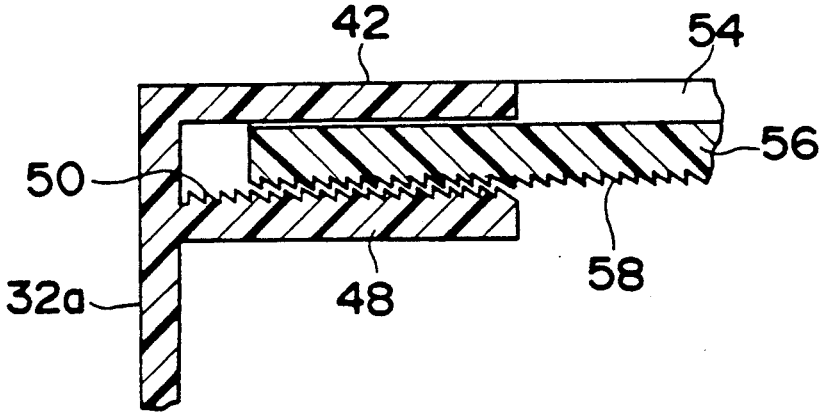
FIG. 3 is a cross sectional view of the lever unit shown in FIG. 1.

On a bottom 48 of the guide channel 46, a series of wave-shaped claws 50 are formed parallel to the left side portion 32*a*. Each claw 50 has a serration-like configuration inclined toward the left side portion 32*a*, as best shown in FIG. 3.

The left side member 30*a* comprises a pivot pin 34*a* provided on one end corner, away from the first arm portion 42.

The left side member 30*a* further has a guide groove 38*a* engraved by a predetermined depth in the second surface and opened near an end corner 36*a*, far from both the pivot pin 34*a* and the first arm portion 42. The left side member 30*a* further has a guide channel hole 40*a* configured in a curved line shape. The guide groove 38*a* and the guide channel hole 40*a* are integrally connected and located such that the distance from the pivot pin 34*a* gradually changes from a maximum at the guide groove 38*a* to a minimum at the end of the guide channel hole 40 away from the guide groove 38*a*.

The plug member 30*b* is formed in a configuration very similar and symmetrical to the receptacle member 30*a*. The plug member 30*b* has a right side portion 32*b* provided with an end corner 36*b*, pivot pin 34*b*, guide channel 38*b*, guide groove channel 40*b*, and second arm portion 52.

The second arm portion 52 extends in a direction perpendicular to the right side portion 32*b* by a predetermined length, in a similar manner to the first arm portion 42. However, the second arm portion 52 has no guide groove therein, but has a plug portion having an inverted T-shaped cross section. This plug portion is defined by a top block 54 and a base block 56 each corresponding to the top opening 42 and the guide groove 46, respectively. Thus, the plug portion 54 and 56 of second arm portion 52 can be inserted into the guide channel 46 with top opening 44 and held stably therein.

A series of wave-shaped claws 58 is formed on the bottom surface of the base block 56 (shown in FIG. 3), running in a direction parallel to the right side portion 32*b*. Each claw 58 has a serration-like configuration inclined toward the right side portion 32*a*, as best shown in FIG. 3. Thus, the claws 50 and 52 are inclined to the directions opposed to each other when the second arm portion 52 is inserted into the first arm portion 42.

Because of this construction, the plug arm 52 inserted in the guide channel 46 is fixed by the engagement between wave-shaped claws 50 and 58 formed on the receptacle and plug members 42 and 52, respectively. The distance between the receptacle member 30*a* and the plug member 30*b* can thus be adjusted. It is therefore possible to adjust the inner width, distance between the left and right side members 32*a* and 32*b*, of the lever unit 30 to the width of the receptacle unit 10 housing 11. Therefore, it is not necessary to prepare different sizes of lever units according to those of connector housings, resulting in reduction of variation and manufacturing cost of lever units. It is to be noted that wave-shaped claws 50 and 58 can be designed as any other profile and orientation which functions to engage each other to position and hold the plug member 30*b* in the guide channel 46.

The receptacle unit 10 further comprises a fixture unit 19 provided on the opposite peripheral sides of the housing 11, proximal to the receptacle space 13 end, with a predetermined clearance therebetween. A pair of elongated slots 19*a* are provided approximately at a middle of the fixture 19, such that each elongated slot 19*a* extends in a direction approximately parallel to the second wire accommodating chambers 15 and opens at the end side thereof.

The lever unit 30, thus assembled as described above, is installed in the predetermined clearance between the housing 11 and the fixture unit 19 such that each of pivot pins 34*a*, 34*b* is captured by elongated slots 19*a* and the guide grooves 30*b* face on the opening space 13 end. Thus, the lever unit 30 can pivot freely in the direction shown by the arrow A, with respect to the axis X and can slide along the elongated slots 19*a*. When the lever unit 30 is turned up to locate at a stable position over the housing 11, the guide grooves 38*a* and 38*b* almost overlaps the slots 17.

The operation features of the lever type connector according to the present invention, described above, are described herebelow.

When connecting the receptacle and plug units 10 and 20, the lever unit 30 is first turned back to the open position shown in FIG. 1. Then, the plug unit 20 is inserted in the receptacle space 13 of the receptacle unit 10 in the direction of arrow B. The guide pins 24 of the plug unit 20 will be guided into the slots 17 and guide channel holes 40*a* and 40*b* by the guide groove 38*a*.

Then, the lever unit 30 arms are lifted up and rotated in the direction of arrow A, the guide channel holes 40*a* and 40*b* capture and press the guide pins 24 along the elongated slot 19*a*. This is because the distance between the pivot pins 34*a* and 34*b* and the guide channel holes 40*a* and 40*b* becomes short as the lever unit 30 rotates in the direction A, as described the above. This pulls the plug unit 20 into the receptacle unit 10, creating a positive contact between the female and male terminals of wires held in the chambers 23 and 15.

Because the force is applied to the arms of a lever unit 30 which turns on pivot pins 34*a* and 34*b*, the principle of a lever and fulcrum works to reduce the force required to establish a positive connection between the plug and receptacle units 20 and 10.

Figure 4:
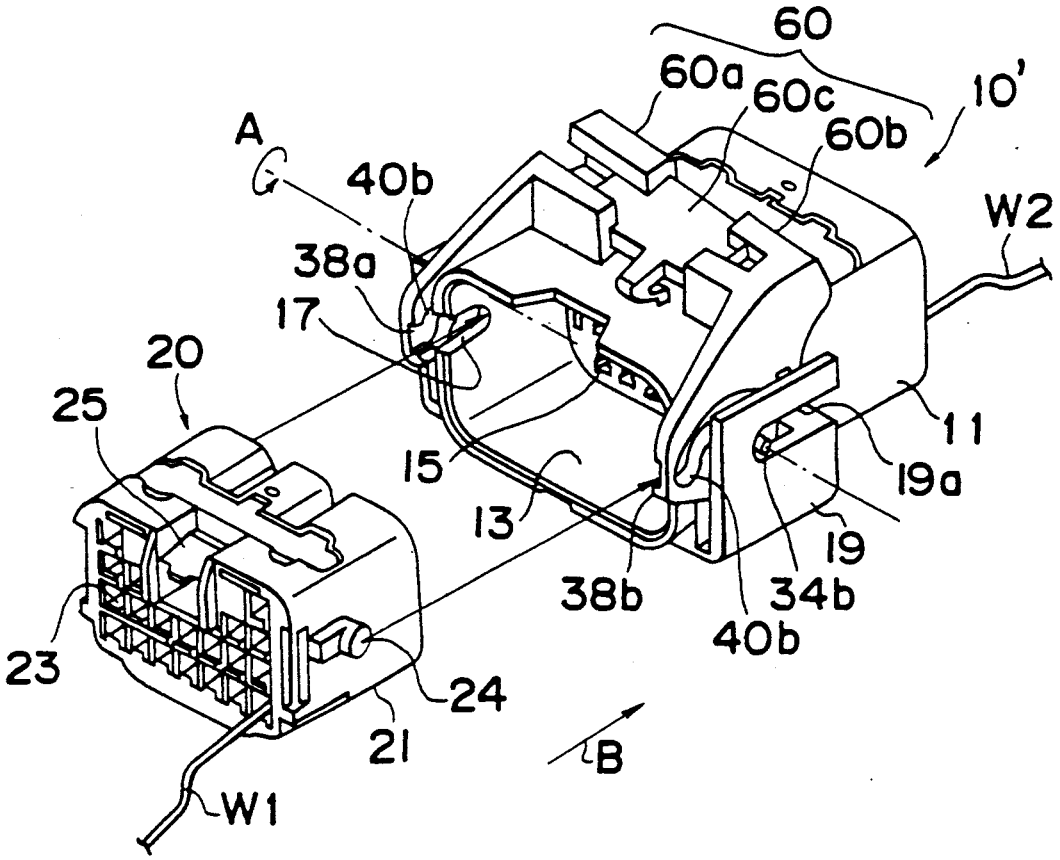
FIG. 4 is an exploded perspective view of a lever type connector with an alternative lever unit according to the present invention.
Figure 5:
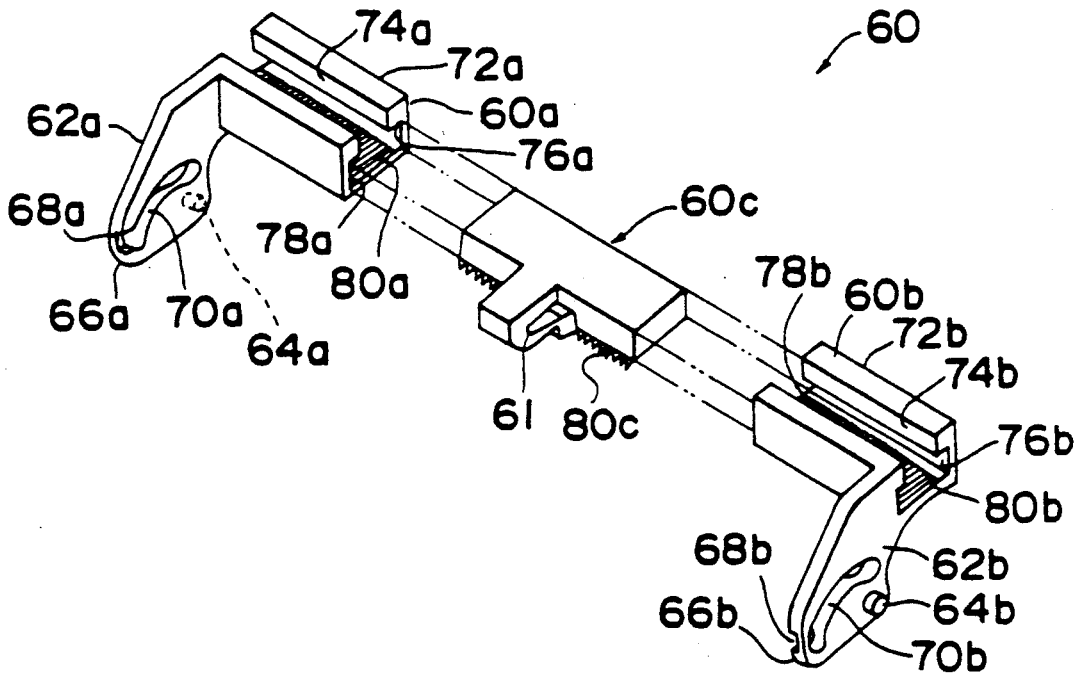
FIG. 5 is an exploded perspective view of the lever unit shown in FIG. 4.
Figure 6:
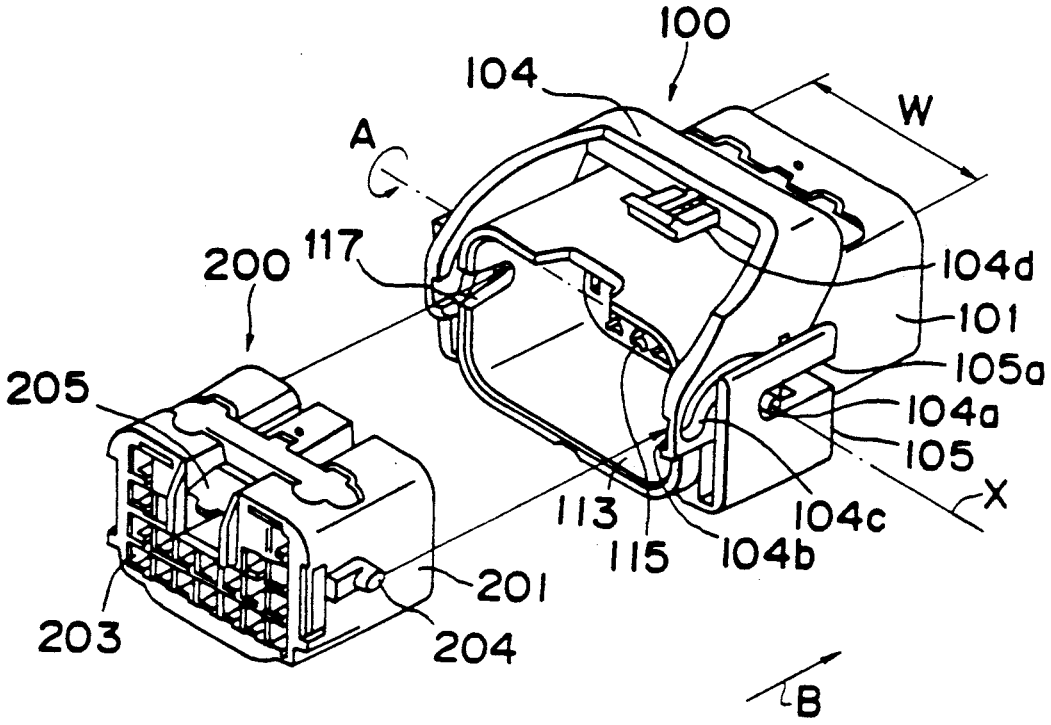
Fig. 6 PRIOR ART
FIG. 6 is an exploded perspective view of a conventional lever type connector.

Referring to FIGS. 4 and 5, an alternative of lever unit 30 according to the above described embodiment is shown. In this alternative, a lever unit 60 comprises a first receptacle member 60*a*, a second receptacle member 60*b*, and a plug arm 60*c* inserted therebetween. This alternative lever unit 60 is installed on a receptacle unit 10', as shown in FIG. 4.

As best shown in FIG. 5, the first receptacle member 60*a* has a construction very similar to that of the receptacle member 30*a* such that left side portion 32*a*, end corner 36*a*, guide channel 38*a*, guide channel hole 40*a*, first receptacle arm portion 42, top opening 44, guide channel 46, bottom 48, and wave-shaped claws 50 of the receptacle member 30*a* are replaced by a first left side member 62*a*, a first end corner 66*a*, a first guide groove 68*a*, a first guide channel hole 70*a*, a first receptacle arm 72*a*, a first top opening 74*a*, a first guide channel 76*a*, a first bottom 78*a*, and first wave-shaped claws 80*a*, respectively, in the first receptacle member 60*a*. The guide channel 70*a* is opened at both ends, as shown in FIG. 5, but can be closed by the left side member 62*a* such as in the receptacle member 30*a*.

The second receptacle member 60*b* is in a form substantially symmetrical to that of the first receptacle member 60*a*, resulting in comprising a second left side member 62*b*, a second end corner 66*b*, a second guide groove 68*b*, a second guide channel hole 70*b*, a second receptacle arm 72*b*, a second top opening 74*b*, a second guide channel 76*b*, a second bottom 78*b*, and second wave-shaped claws 80*b*.

The plug arm 60*c* is formed in a flat plate-like configuration having a cross sectional shape, enabling insertion in the guide channels 76*a* and 76*b*. A series of wave-shaped claws 80*c* is formed on the bottom of the plug arm 60*c* for the engagement with the wave-shaped claws 80*a* and 80*b* in the guide channels 76*a* and 76*b*. The first and second receptacle members 60*a* and 60*b* are formed substantially symmetrical to each other, as described above. Therefore, the claws 80*a* and 80*b* are inclined to the opposite directions when the first and second receptacle members 60*a* and 60*b* are installed on the receptacle housing 11.

In this case, the third claws 80*c* on the bottom of plug member 60*c* are divided in two groups with respect to the inclined direction thereof. The claws 80*c* in the first group is inclined to a direction to engage with the first claws 80*a*. The claws 80*c* in the second group inclined to an opposite direction in which those in the first group is inclined. The plug arm 60*c* can be fixed by the each group of third claws 80*c* engaged with the first and second claws 80*a* and 80*b*, respectively, when inserted into them.

However, the third claws 80*c* all can be inclined in a single direction. For example, the third claws 80*c* can be inclined in a direction to engage with the first claws 80*a*, when the second claws 80*b* is inclined to an opposite direction from the direction in which the second claws 80*b* is originally inclined. The third claws 80*c* also can be inclined in a direction to engage with the second claws 80*b*, when the first claws 80*a* is inclined to an opposite direction from the direction in which the first claws 80*a* is originally inclined.

The lever unit 60 is further provided with a flexible locking tab 61 at approximately middle portion of one of side edges of the plug portion 60*c*. This locking tab 61 engages with a locking slot 25 provided in the housing 21 of the plug unit 20.

Because of this construction, the length of plug arm 60*c* inserted in the guide channels 76*a* and 76*b* of the first and second receptacle arms 72*a* and 72*b* can be changed. The effective length of each of arms 72*a*, 72*b*, and 72*c* can thus be controlled to adjust the distance between the left and right side members 62*a* and 62*b*. It is therefore possible to adjust the inner width of the lever unit 60 equal to the width of the housing 11 of the receptacle unit 10'. Thus, a single lever unit 60 can be used with connector housings of different sizes.

In addition, when the lever unit 60 is lifted in the direction of the arrow A to connect the plug and receptacle units 20 and 10', the plug unit 20 is pulled into the receptacle space 13 of the unit 10'. Thus, electrical terminals therein are mated for establishment of electrical connection therebetween. Furthermore, the locking tab 61 engages with the locking slot 25. This locks the connection between the plug and receptor units 20 and 10', and prevents accidental disconnection.

It will be known to those skilled in the art that the present invention can be varied in many ways. For example, in the alternative lever unit 60 described above, a rectangular guide channel can be provided in the plug arm 60*c*. In this case, the first and second receptacle arms 60*a* and 60*b* can be rectangularly shaped, enabling themselves to insert in the guide channel of the plug arm 60*c*. The wave-shaped positioning claws can also be provided in any form and in any position suitable for fixing the arms by the means of mutual engagement of claws.

In addition, the positioning means used to adjust and hold the length of the lever arm members shall not be limited to the described wave-shaped claw construction, and may be of various known designs.

In a lever type connector according to the present invention, the following benefits are obtained with the construction thereof, as described above.

First, because the arm length of the lever unit is adjustable, a single lever unit can be used with connector housings of varying widths. This eliminates the need to mold levers for each size of connector housing, and thus reduces production costs.

Specifically, when the lever is composed of two parts (receptacle member and plug member), the arm of the plug member is inserted to the guide channel in the arm of the receptacle member, and a wave-shaped or other type of positioning means is provided, the arm length of the plug member inserted to the guide channel can be adjusted, and the overall arm length of the lever until can thus be adjusted.

In addition, when the lever unit is composed of three parts such that the third part is inserted into the guide channels provided in the arm member of each of the other two parts, the arm length of the lever unit can be adjusted to the width of the connector housing by varying the length by which the third part is inserted into the guide channels.

Furthermore, the connection between the receptacle and plug units can be locked by a locking tab which is provided on this third part, such that the locking tab engages with a locking slot provided in the plug unit housing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A lever type connector, which is used to connect at least one pair of first and second terminals, comprising:

a first connector member for accommodating said first terminal therein and provided with a first engaging means and a second engaging means;

a second connector member for accommodating said second terminal therein and provided with a third engaging means engageable with said first engaging means; and a substantially U-shaped lever unit pivotally provided on said second connector member and having a center portion and two side portions connected to the opposite ends of said center portion, said center portion comprising length variable means for adjusting a length of said center portion according to a width of said second connector, so that said lever unit is operative to accommodate connectors of varying widths, said side portions being provided with a fourth engaging means engageable with said second engaging means, whereby when said lever unit pivots, said second engaging means engages with said fourth engaging means to force said first and second connector members into a firmly engaged state.

2. A lever type connector means which is used to connect at least one pair of a first terminal and a second terminal, said connector means comprising:

a first connector member in a cubic-shaped form having first and second sides opposed to each other and four peripheral sides integrated with said first and second sides for holding said first terminal therein in a first direction approximately perpendicular to said first and second sides, said first connector member being provided with a pair of guide pins each on two opposite sides of said four peripheral sides generally in an alignment with a line perpendicular to said first direction;

a second connector member in a box-shaped form having a ceiling wall and four peripheral walls integrated with said ceiling wall for holding said second terminal at a second direction approximately perpendicular to said ceiling wall, said second connector member having an opening defined therein in opposition to said ceiling wall, which opening includes an opening edge and is adapted to accommodate said first connector member therein, said second connector member including a pair of slots extending to said opening edge;

a lever unit for pressing said first connector member into said opening comprising:

a first elongated side plate means provided with a first pivot pin on one side thereof and a first guide channel hole;

a second elongated side plate means provided with a second pivot pin on one side thereof and a second guide channel hole; and a length variable arm means extending between said first and second elongated side plate means for joining sides thereof apart from said first and second pivot pins, said length variable arm means operative to adjust a length thereof according to the width of said first connector member; and a pair of support means for supporting said pivot pins therein provided on two opposite sides of said four peripheral walls with a predetermined clearance corresponding to the width of said first and second side plate means from said opposite sides and generally in an alignment with a line substantially parallel to said opening edge, whereby when said lever unit is pivoted down with respect to said pivot pins, said first connector means is inserted in said opening of said second connector means as said guide pins are captured by spaces concurrently shared by said guide channel holes and said slots, and said guide pins are pressed by said guide channel holes along said slots, causing said first and second connector means to be firmly engaged.

3. A lever type connector as claimed in claim 2, wherein said length variable arm means comprises:

a receptacle member integrally connected to said first elongated side plate means, said receptacle member being provided with an elongated guide channel formed therein to extend in the longitudinal direction and to have an opening at the end side opposite said first elongated side plate means;

a plug means integrally connected to said second elongated side plate means, said plug means having a cross sectional configuration to fit in said guide channel; and a pair of positioning means separately provided in said guide channel and said plug means for positioning and holding said plug means when inserted into said guide channel.

4. A lever type connector as claimed in claim 2, wherein said length variable arm means comprises:

a first receptacle member integrally connected to said first elongated side plate means; said first receptacle member being provided with a first guide channel formed therein to extend parallel in the longitudinal direction and to have a first opening at the end side opposite to said first elongated side plate means;

a second receptacle member integrally connected to said second elongated side plate means, said second receptacle member being provided with a second guide channel formed therein to extend parallel in the longitudinal direction and to have a second opening at the end side opposite to said second elongated side plate means;

a intermediate plug member in a parallel elongate plate shape having an cross sectional configuration fitting in said first and second guide channels, said intermediated plug member being provided with a locking tab for mating with said locking slot to lock said first and second connector members together;

a first positioning means provided in said first guide channel;

a second positioning means provided in said second guide channel; and a third positioning means provided in said intermediate plug member for positioning and holding said intermediate plug means when inserted into said first and second receptacle members by engaging with said first and second positioning means, respectively.

* * * * *